US005496214A

United States Patent [19]

Marcreigns

[11] Patent Number: 5,496,214

[45] Date of Patent: Mar. 5, 1996

[54] APPARATUS FOR REMOVING SMOKE

[76] Inventor: Anthony Marcreigns, P.O. Box 205, Mangum, Okla. 73554

[21] Appl. No.: 396,667

[22] Filed: Mar. 1, 1995

[51] Int. Cl.[6] ..... F24F 7/007

[52] U.S. Cl. ..... 454/341

[58] Field of Search ..... 454/49, 341, 345, 454/41

[56] References Cited

U.S. PATENT DOCUMENTS

| | | | |
|---|---|---|---|
| 116,049 | 6/1871 | Gouge | 454/345 X |
| 627,719 | 1/1899 | Coady | 454/41 |
| 780,247 | 1/1905 | Wilcox | 454/345 |
| 980,471 | 1/1911 | Zenke | 454/345 |
| 2,875,679 | 3/1959 | Humbert | 454/344 |
| 4,134,545 | 1/1979 | Westbrook | 454/233 X |
| 4,351,475 | 9/1982 | Hudson | 454/236 X |
| 5,314,376 | 5/1994 | Kuramarohit | 454/236 X |

FOREIGN PATENT DOCUMENTS

| | | | |
|---|---|---|---|
| 635931 | 9/1936 | Germany | 454/230 X |
| 2833775 | 2/1980 | Germany | 454/230 X |
| 440210 | 2/1992 | Japan | 55/467 X |
| 2110815 | 6/1983 | United Kingdom | 454/230 |

*Primary Examiner*—Harold Joyce
*Attorney, Agent, or Firm*—Craig W. Roddy

[57] ABSTRACT

An apparatus for removing smoke from an enclosed area. The apparatus comprising an outer column, wherein the outer column is hollow and has a plurality of apertures for receiving the smoke therein. An inner column having cooperative openings and extensions is rotatably mounted inside the outer column for collecting the smoke therein. A fan positioned in the inner column directs the smoke outside through a vent opening. Additionally, a drain is provided for removing moisture from the apparatus.

20 Claims, 3 Drawing Sheets

APPARATUS FOR REMOVING SMOKE

BACKGROUND

The present invention relates generally to an apparatus for removing smoke, and more specifically, to an apparatus for removing smoke from inside an enclosed structure such as a restaurant, night club, lounge or hotel.

A common problem exists in alleviating harmful tobacco smoke from an enclosed area having a large number of persons who are smoking. Although ventilation systems are known in the art, they are incapable of effectively removing the smoke.

The preferred version of the present invention provides an efficient smoke removing apparatus which is constructed to effectively remove smoke from an enclosed area. Further, the apparatus may be produced to accommodate structures of various sizes and to cooperate with the decor located therein.

Hence, there is a need for a simple, economical and effective apparatus for removing smoke from an enclosed area; however, until now, no such apparatus has been developed.

SUMMARY

The preferred embodiment of the invention is directed to a smoke removal apparatus which provides an efficient and economical way of eliminating smoke from an enclosed area and is well suited for use in buildings such as clubs and lounges where large numbers of smokers are gathered.

The present version of the invention comprises an apparatus having a outer column which is hollow and contains a plurality of apertures for receiving smoke therein. The outer column generally extends from the floor to the roof of a structure. An inner column having cooperative openings and extensions is rotatably mounted inside the outer column for collecting smoke therein. A fan located inside the inner column directs the collected smoke towards a venting means for removal to the outside air. Additionally, a drain is attached to the apparatus for removing moisture therefrom.

As such, it is a first object of the present invention to provide an efficient, economical, and simple apparatus for removing smoke.

It is a further object of the present invention to provide an apparatus which is substantially self-contained within the enclosed area containing smoke.

It is a further object of the present invention to provide an apparatus which has a rotatably mounted inner column for collecting smoke therein.

It is a further object of the present invention to provide an apparatus which has a fan in cooperation with a rotating inner column for directing smoke therefrom.

It is a further object of the present invention to provide an apparatus which has an enclosed sloped bottom and drain for removing moisture therefrom.

It is a final object of the present invention to provide an apparatus which effectively collects and removes smoke from an enclosed area.

BRIEF DESCRIPTION OF THE DRAWINGS

These and other features, aspects, and advantages of the present invention will become better understood with regard to the following description, appended claims, and accompanying drawings where:

DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications, and equivalents, which may be included within the spirit and scope of the invention as defined by the appended claims.

Figure 1A:
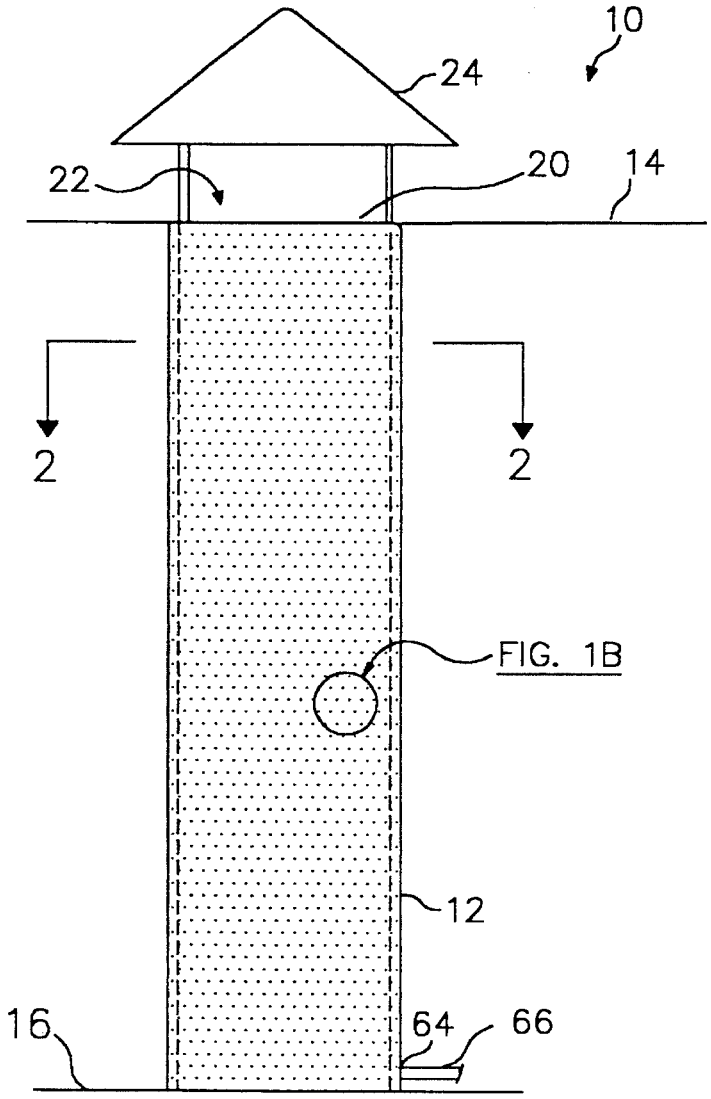
FIG. 1A shows a front elevation view of an apparatus for removing smoke constructed in accordance with the present embodiment of the invention.
Figure 3:
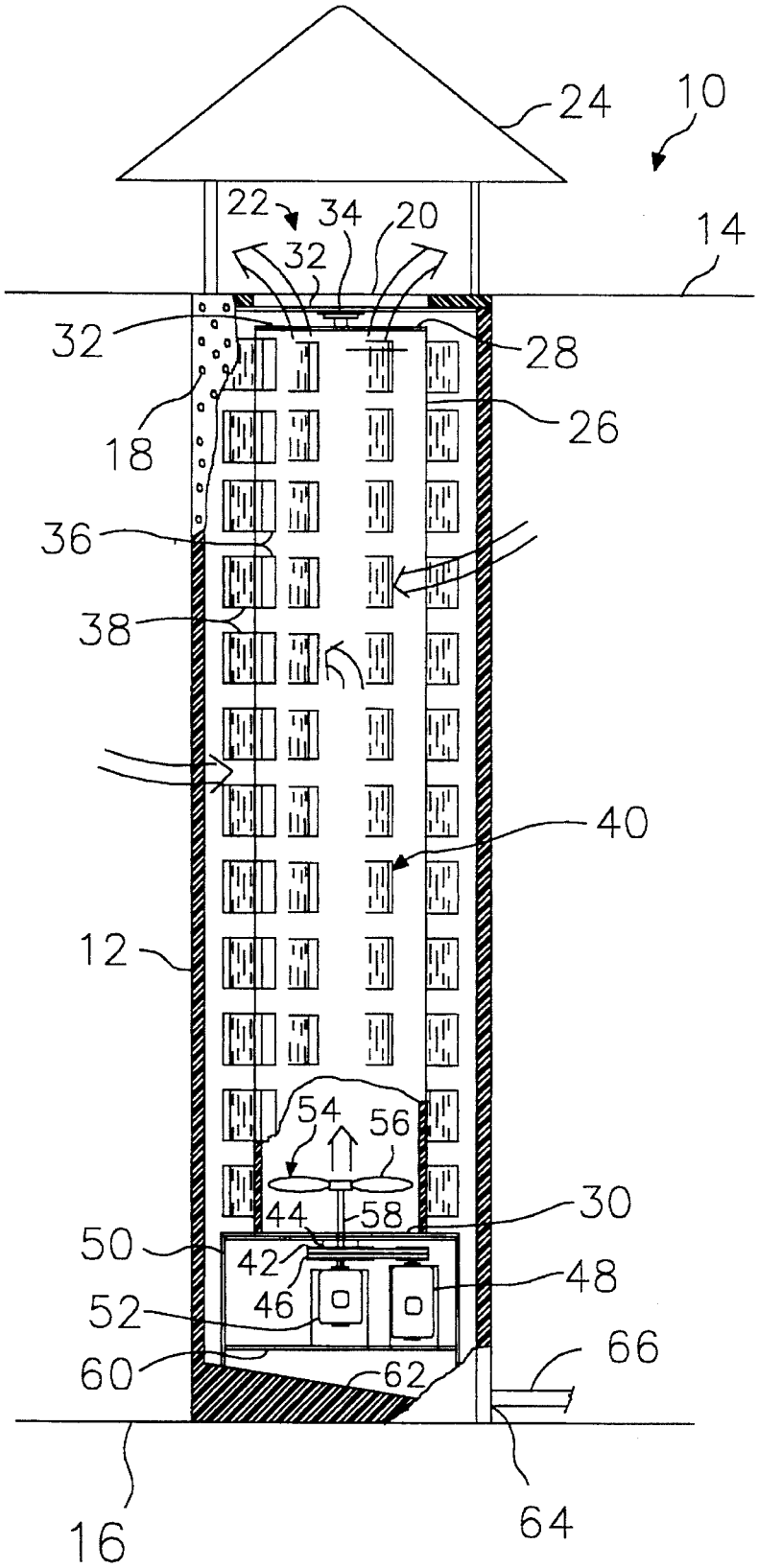
FIG. 3 is a partial cross section view of FIG. 1.

As best illustrated in FIGS. 1A and 3, the preferred embodiment of the invention relates to an apparatus 10 for collecting and removing smoke. The apparatus 10 is preferably used inside an enclosed structure such as a lounge or club where large numbers of smokers are gathered.

Figure 1B:
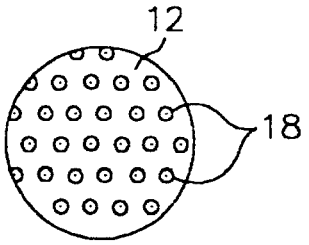
FIG. 1B is an enlarged partial elevation view of the outer column and apertures in FIG. 1A.

Referring to FIG. 1A, the preferred embodiment of the invention includes an outer column 12 fixedly positioned within an enclosed structure, wherein the column 12 generally extends from a roof 14 to a floor 16 thereof. The column 12 is hollow and contains a plurality of apertures 18 for receiving smoke therein, see FIG. 1B.

An opening in the roof 14 is in cooperative communication with an open top end 20 of the outer column 12, whereby a venting means 22 is provided for removing smoke from the apparatus 10 to the outside air. Additionally, a cap 24 is provided on the roof 14, wherein the cap 24 generally covers the venting means 22 to prevent foreign objects from entering the apparatus 10. The cap 24 allows the apparatus 10 to sufficiently communicate with the outside air.

Figure 2:
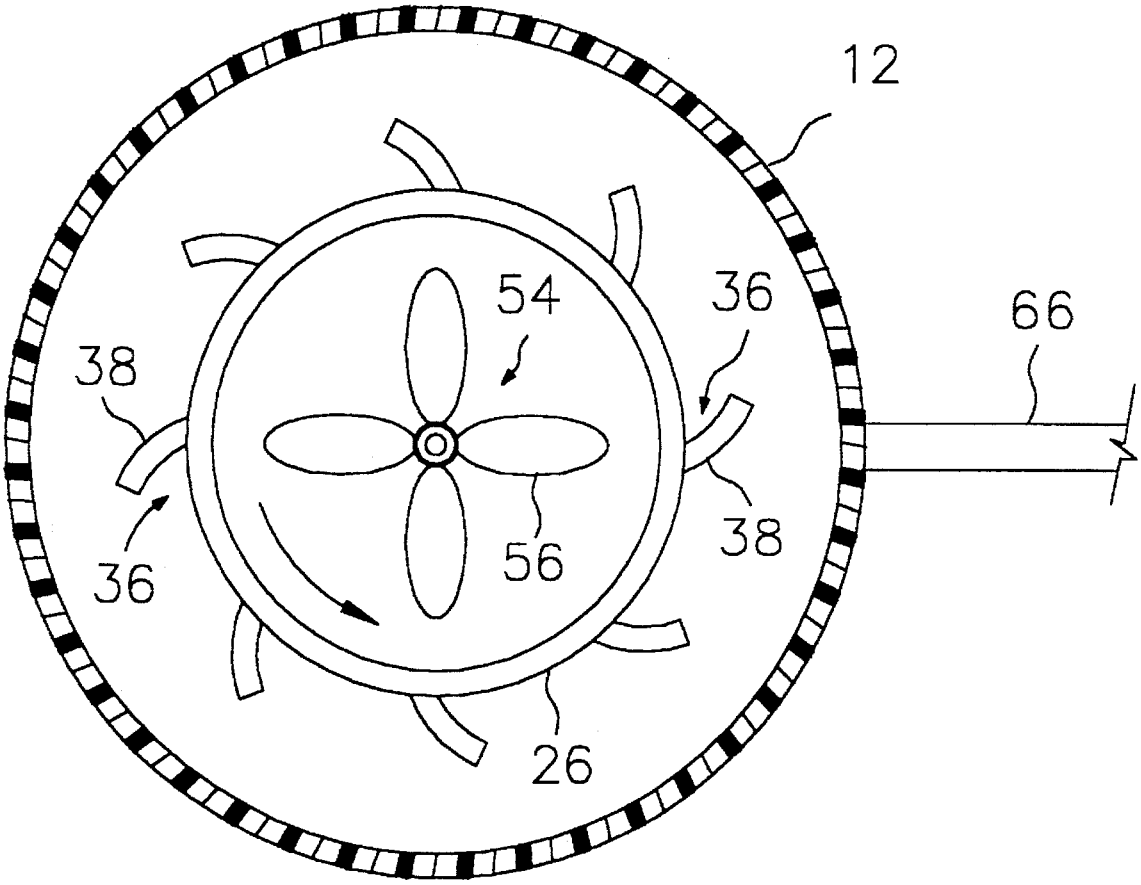
FIG. 2 is a cross section view taken along line 2—2 of FIG. 1.

As shown in FIGS. 2 and 3, an inner column 26 is rotatably mounted inside the outer column 12 and extends through a substantial portion thereof. The inner column 26 is preferably positioned within the central portion of the outer column 12. Therefore, the inner column 26 is allowed to freely rotate inside the outer column 12.

An open top end 28 of the inner column 26 is located adjacent the open top end 20 of the outer column 12, wherein the inner column 26 is in communication with the venting means 22. An enclosed bottom end 30 of the inner column 26 is located opposite the top end 28 thereof.

Preferably, the open top end 28 of the inner column 26 and the open top end 20 of the outer column 12 each have a strip 32 of metal or suitable material extended thereacross for coupling with a ball bearing type axle 34 or other known rotatable support therebetween. The strips 32 do not inhibit sufficient air movement through the venting means 22. Thus, the inner column 26 is securely supported by the axle 34 for even rotation within the outer column 12.

The inner column 26 contains a plurality of openings 36 and generally curved extensions 38, wherein the extensions 38 direct smoke through the openings 36 and into the column 26 as it rotates, see FIG. 2. The inner column 26, openings 36 and extensions 38 provide a collecting means 40 for collecting the smoke.

The bottom end 30 of the inner column 26 is attached to a pulley 42 by a first shaft 44, wherein a belt 46 extends between the pulley 42 and a first motor 48 for rotating the inner column 26. The pulley 42 has a central opening (not shown) defined therethrough.

Additionally, the inner column 26 is rotatably supported by a support 50 which is made of metal, plastic, wood or other suitable material, wherein the first shaft 44 extends through the support 50 for joining with the inner column 26. Lubricated ball bearings (not shown) or other suitable means known in the art are included, wherein the inner column 26 freely moves against the support 50 while supported thereby.

A second motor 52 is used to operate a moving means 54 for moving the smoke collected in the inner column 26. Preferably, the moving means 54 includes an electric fan 56 known in the art, wherein fan blades are located inside the inner column 26.

A second shaft 58 extends through the hollow center of the pulley 42 to connect the fan 56 with the second motor 52. Hence, the second shaft 58 extends through the pulley 42 and bottom end 30 of the inner column 26 to independently operate the fan 56 located within the inner column 26.

Known components such as electrical wiring and a power switch for controlling the motors 48, 52 are not illustrated and are unnecessary for understanding the present embodiment of the invention. Furthermore, the first and second motors 48, 52 are preferably electrical motors known in the art.

As shown in FIG. 3, the support 50 has a shelf 60 to support the first and second motors 48, 52, wherein the motors 48, 52 are elevated above any moisture accumulated in the outer column 12. Moreover, the outer column 12 has an enclosed sloped bottom 62 which allows any moisture gathered therein to be removed through a drain 64.

The drain 64 includes the outer column 12 having a hole defined therethrough, preferably near the bottom 62. A tube 66, such as a copper tube, is coupled to the outer column 12 for receiving moisture from the drain 64, wherein the tube 66 delivers moisture from the apparatus 10 to a sewage drain or the like.

In operation, the first motor 48 rotates the inner column 26, whereby the extensions 38 direct smoke through the openings 36 and into the inner column 26. As the smoke collects in the inner column 26, the fan 56, which is operated by the second motor 52, moves the smoke through the venting means 22 where it is released to the outside air. As the smoke is removed through the venting means 22, additional smoke in the enclosed structure is drawn into the outer column 12 via the apertures 18, wherein the smoke is collected by the collecting means 40 for removal as previously described. Furthermore, moisture accumulated within the apparatus 10 flows to the lowest portion of the bottom 62 where it is removed through the drain 64 and attached tube 66.

The preferred material used in constructing the outer column 12 is plastic although other suitable materials may be used such as fiberglass or wood. Known means such as nails, screws, rivets, adhesives or the like may be used in assembling the apparatus 10 and are not necessary for understanding the present invention.

The previously described version of the invention has many advantages, including a simple, economic and efficient way of removing smoke from an enclosed area. Another advantage of the embodiment of the invention is that the apparatus 10 is substantially self-contained within the enclosed area.

The foregoing descriptions of specific embodiments of the present invention have been presented for purposes of illustration and description. They are not intended to be exhaustive or to limit the invention to the precise forms disclosed and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for removing smoke, comprising:

an outer column having means for receiving the smoke therein;

an inner column rotatably disposed in said outer column;

wherein said inner column has means for collecting the smoke therein when said inner column is rotated; and means for venting the smoke collected in said inner column.

2. The apparatus as recited in claim 1, wherein said means for receiving the smoke in said outer column includes said outer column having a plurality of apertures.

3. The apparatus as recited in claim 1, wherein said inner column extends through a substantial portion of said outer column.

4. The apparatus as recited in claim 2, wherein said means for collecting the smoke in said inner column includes said inner column having an opening and cooperating extension.

5. The apparatus as recited in claim 4, wherein said extension is curved.

6. The apparatus as recited in claim 1, wherein said means for collecting the smoke in said inner column includes said inner column having a plurality of openings and cooperating extensions.

7. The apparatus as recited in claim 2, further comprising means for moving the smoke collected in said inner column.

8. The apparatus as recited in claim 7, wherein said means for moving the smoke collected in said inner column includes a fan.

9. The apparatus as recited in claim 8, wherein said fan is located in said inner column.

10. An apparatus for removing smoke, comprising:

an outer column having means for receiving the smoke therein;

an inner column rotatably disposed within said outer column;

wherein said inner column has an opening and cooperating extension for collecting the smoke therein when said inner column is rotated; and means for venting the smoke collected in said inner column.

11. The apparatus as recited in claim 10, wherein said inner column extends through a substantial portion of said outer column.

12. The apparatus as recited in claim 10, wherein said extension is curved.

13. The apparatus as recited in claim 10, wherein said means for collecting the smoke in said inner column includes said inner column having a plurality of openings and cooperating extensions.

14. The apparatus as recited in claim 10, further comprising means for moving the smoke collected in said inner column.

15. The apparatus as recited in claim 14, wherein said means for moving the smoke collected in said inner column includes a fan.

16. An apparatus for removing smoke, comprising:

an outer column having means for receiving the smoke therein;

an inner column rotatably disposed within said outer column;

wherein said inner column has means for collecting the smoke therein when said inner column is rotated;

means for moving the smoke collected in said inner column; and means for venting the smoke collected in said inner column.

17. The apparatus as recited in claim 16, wherein said inner column extends through a substantial portion of said outer column.

18. The apparatus as recited in claim 16, wherein said means for collecting the smoke in said inner column includes said inner column having an opening and cooperating extension.

19. The apparatus as recited in claim 18, wherein said extension is curved.

20. The apparatus as recited in claim 16, wherein said means for moving the smoke collected in said inner column includes a fan.

* * * * *